United States Patent [19]

Hewitt

[11] 4,423,862

[45] Jan. 3, 1984

[54] ARM WRESTLING DEVICE

[76] Inventor: Jennings P. Hewitt, 6704 W. 14th St., Sioux Falls, S. Dak. 57106

[21] Appl. No.: 271,248

[22] Filed: Jun. 8, 1981

[51] Int. Cl.[3] ..... A63B 23/00

[52] U.S. Cl. ..... 272/67; 272/901; 73/379

[58] Field of Search ..... 272/67, 68, 142, 140, 272/135, 136, DIG. 7

[56] References Cited

U.S. PATENT DOCUMENTS

| | | | |
|---|---|---|---|
| 948,140 | 2/1910 | Johnson | 272/67 X |
| 3,400,793 | 9/1968 | Norris | 272/129 X |
| 3,467,376 | 9/1969 | Feinberg | 272/67 |
| 3,563,542 | 2/1971 | Wellman | 272/67 X |
| 3,649,010 | 3/1972 | Jeffrey | 272/DIG. 7 |
| 3,743,284 | 7/1973 | Rhodes | 272/67 |
| 3,953,026 | 4/1976 | Stokely | 272/140 |
| 3,982,757 | 9/1976 | McDonnell | 272/67 X |
| 4,176,837 | 12/1979 | Jeffrey | 273/1 R |

*Primary Examiner*—Richard J. Johnson
*Attorney, Agent, or Firm*—Anthony G. Eggink

[57] ABSTRACT

The arm wrestling device is for providing a clockwise and counterclockwise rotational resistance force in opposition to the rotation of an individual user's forearm about its respective, stationary elbow joint. The device includes a base structure for supporting the user's rotational forces and the remaining elements of the device. These elements include an elbow placement and receiving means, a rigid lever arm and a clockwise and counterclockwise rotational force resistance means. The rigid lever arm has an upper portion for hand gripping by the user and a lower portion having a generally horizontal axis of rotation. At rest, the lever arm extends in a generally vertical direction in proximity to the elbow placement means so that the user can comfortably grasp the upper portion of the lever arm. Subsequent to elbow placement and hand grasping the user rotates the lever arm in either rotational direction, depending upon left or right handed predisposition, and encounters the resistance force which is communicatively connected to the axis of rotation of the lever arm. The device is equipped with adjustable elbow placement means to effectuate device use for athletic or therapeutic purposes to users irrespective of arm length. The device is also equipped with rotatable gripping handle at the upper portion of the lever arm, adjustable resistance force means, force readout means, and a pair of hand gripping posts to closely assimilate the sport of arm wrestling.

1 Claim, 5 Drawing Figures

ARM WRESTLING DEVICE

This invention relates to a device for arm wrestling. Particularly, this invention relates to a device for providing a clockwise and counterclockwise rotational resistance force in opposition to an individual user's rotational motion of the left or right forearm about its respective, generally stationary elbow joint.

Arm wrestling devices according to the invention are useful as a uniform and reproducible mechanical arm wrestling opponent for both therapeutic and competitive purposes. And, these devices are especially useful for allowing individual users to participate irrespective of physical strength, arm length or predisposition towards the left or right hand.

The sport of arm wrestling has long been recognized as a popular recreational event. In addition to its competitive nature, its contestants have recognized the physical requirements of the sport to have entertainment and therapeutic value, and to be useful for physical training purposes.

However, the sport of arm wrestling has long been restricted to a select group of participants. This restriction has been the result of the very nature of the sport itself, which requires the matching of two individual contestants having generally equal arm length to avoid unfair advantage to the longer armed contestant. Additionally, contestants are usually matched in classes that are based on the individual's weight or strength and according to their predisposition towards left or right hand. Even then, an undisputed winner is difficult to determine simply because a winning effort cannot be repeatedly reproduced by the same contestant due to physical exhaustion.

The rules with respect to the sport of arm wrestling are generally straightforward. Two contestants face each other in a sitting or standing fashion across a planar surface. Subsequent to clasping hands and having their respective elbows in general proximity, each contestant applies a force to internally rotate the clasped hand about the planted and generally stationary elbow joint. The contestant first able to touch the back of the opponents hand to the planar surface is declared the winner. Despite this generally simple technique, much controversy often ensues due to the inherent participant physical differences as enumerated above.

Despite the longstanding need to make the sport of arm wrestling one in which all can participate with minimal controversy, irrespective of the individual's strength, arm length or predisposition towards the left or right hand, no one insofar as is known has heretofore offered any practical solutions. A practical and effective arm wrestling device for individual contestants is provided by the teachings of this invention. The device provides a mechanical arm wrestling opponent which is adjustable for individual use, and one which provides a standard that is reproducible for competitive, training and therapeutic purposes.

In summary, this invention provides a device for furnishing a generally uniform clockwise and counterclockwise rotational resistance force in opposition to an individual user's rotational motion of the left or right forearm about its respective, generally stationary elbow joint. The device includes a base structure for supporting the user's elbow and the remaining elements of the device.

The remaining elements of the device include an adjustable elbow placement and receiving means, a rigid lever arm and a clockwise and counterclockwise rotational force resistance means. The lever arm has an upper portion for receiving the gripped hand of a user, and a lower portion having a generally horizontal axis of rotation and being communicatively journaled to the base structure. At rest and before use, the lever arm extends in a generally vertical direction in proximity to the elbow placement means so that the user can comfortably grasp the upper portion of the lever arm subsequent to proper elbow placement means adjustment. The clockwise and counterclockwise rotational force resistance means is in communication with the lower portion of the lever arm at its rotational axis so that as the user attempts to rotate the forearm about the elbow, this resistance force is encountered.

Additionally provided by the invention is a resistance force readout means to provide the user with comparative results for either therapeutic or competitive purposes. Also provided is a rotatable gripping handle at the upper portion of the lever arm, and a pair of hand gripping posts fixed to the base structure spacially removed on each side of the lever arm for gripping by the other hand of the device user.

Also provided by the invention is a fulcrum spring and cable arrangement attached to the base structure for furnishing the device its clockwise and counterclockwise rotational resistance force. Additionally, this arrangement provides resistance force adjustment means.

These and other benefits of this invention will become clear from the following description by reference to the drawings, wherein.

Figure 1:
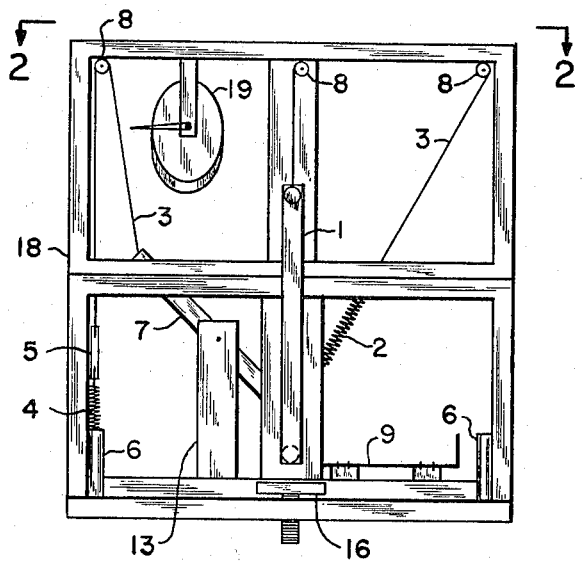
FIG. 1 is a schematic frontal plan view of the device of the invention having its outside covering removed.
Figure 2:
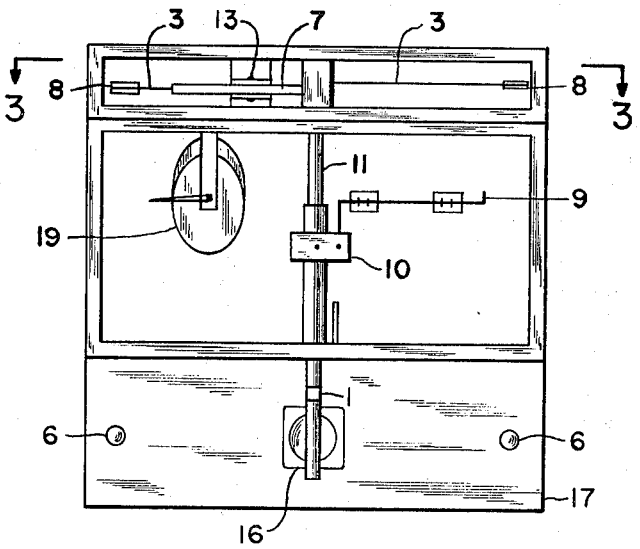
FIG. 2 is a schematic top plan view of the device of the invention taken on lines 2—2 of FIG. 1.
Figure 3:
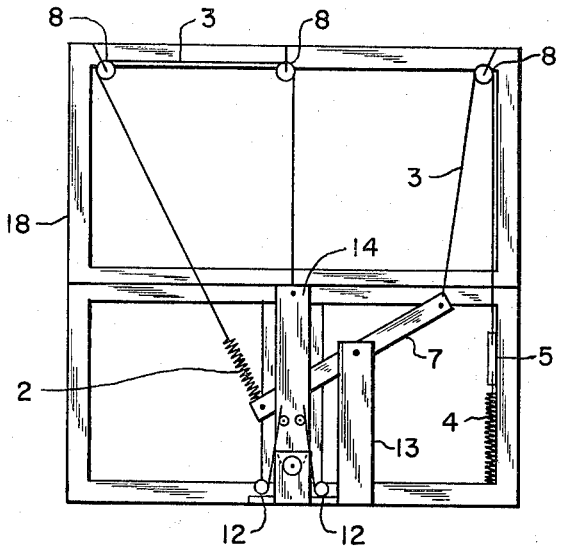
FIG. 3 is a schematic plan view of the back of the device taken on lines 3—3 of FIG. 2.
Figure 5:
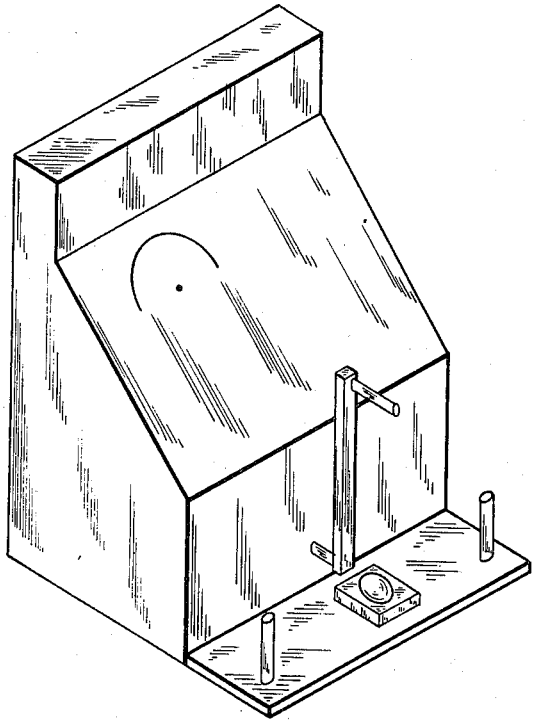

Referring to FIGS. 1, 2 and 3 an arm wrestling device is illustrated as having a base or frame structure 18. Base structure 18 is a generally rectilinear structure for receiving the remaining elements of the device. The structure is generally rigid and can be constructed of tubular or angular steel members, or the like, which are easily connected and readily machineable to receive other elements. The base structure 18 can be mounted to a wall for use or mounted to a pedestal, and is designed to receive an outside or exterior covering as shown in FIG. 5 of the drawings. Thus, the base structure 18 must be strong enough to support the remaining elements of the device in addition to the rotational forces of the device users. Although steel construction has been utilized, the utilization of other metals, wood or plastic would likewise be possible.

A planar base or playing structure 17 is illustrated as extending generally horizontally from base structure 18. The playing or planar base can be connected to or integral with base structure 18. An adjustable elbow placement and receiving means 16 is illustrated extending upward from the planar or playing base 17. The elbow placement means or elbow cup 16 is shown as a generally horizontal plate, preferably having an indented or hollowed portion for comfortably receiving the elbow of the device user, and a threaded shaft member which is received and which extends through base 17. The threaded shaft member can be rotated through an internally threaded aperture which extends through base 17 in order to adjust the height of the elbow cup 16 from base 17. The internally threaded aperture can be integral with base 17 or can be inserted thereinto. The adjustable height of the elbow cup 16 allows the user to control the distance between it and the upper portion of lever arm 1.

Figure 4:
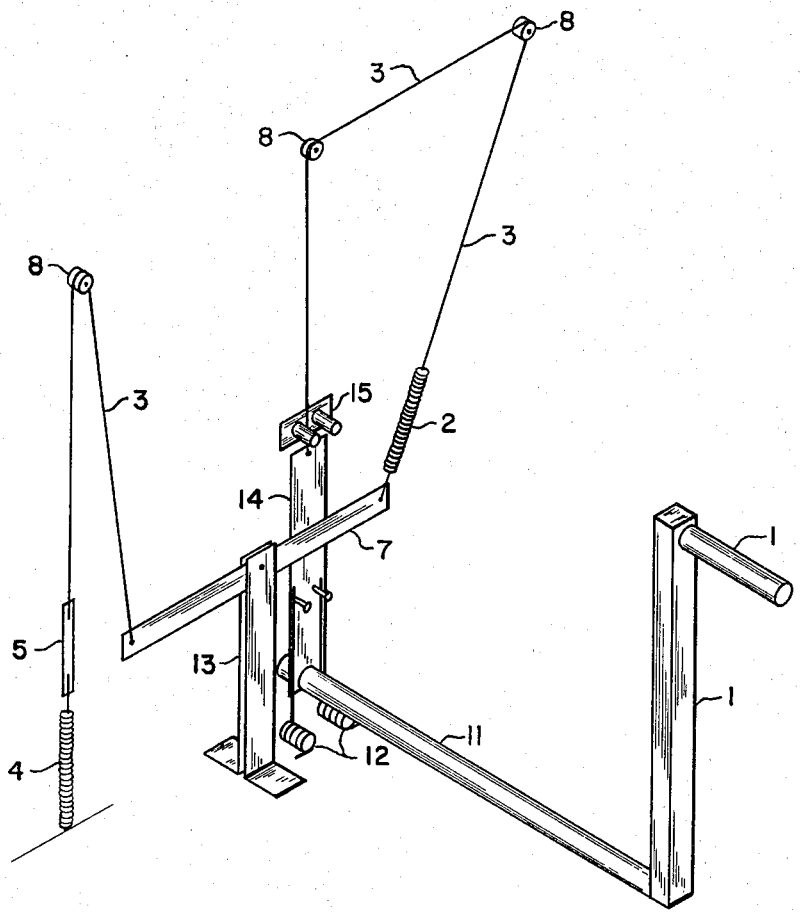
FIG. 4 is a perspective view of the rotational resistance force mechanism of the device of the invention as shown in FIGS. 1, 2 and 3; and, FIG. 5 is a perspective view of the device of the invention having its exterior covering in place about its base structure.

As shown in FIGS. 1 and 2, a rigid lever arm 1 extends in a generally vertical direction upward and above the playing base 17. The lever arm 1 has an upper portion for grasping by the user of the device and a lower portion which has a generally horizontal axis of rotation. As shown in FIG. 4, a shaft member extends from the lower portion of lever arm 1 along the axis of rotation thereof. The shaft member 11 is journaled for rotation, and the journals are connected to base structure 18.

At the upper portion of lever arm 1 a generally outward and horizontal extending rotatable hand gripping handle is preferably provided. The gripping handle extends generally spacially above the elbow cup 16 so that subsequent to adjustment of the elbow cup a user can comfortably reach the gripping handle thereabove. The gripping handle is preferably rotatable so that as the user rotates the lever arm 1, the surface that is gripped does not rotate but maintains generally stationary in the user's grippped hand.

As is a commonly accepted practice in the art of arm wrestling, a pair of hand holds or gripping posts 6 are fixed to the playing base 17 on either side of elbow cup 16. These holds or posts 6 provide an unquestionable and definite place for the user of the device to locate the unused hand and prevents user's to gain unfair advantage. They likewise add to the reproducibility of the device.

As is best illustrated in FIG. 4 of the drawings, the rotational resistance force mechanism of the device includes a cable bar or cable attachment lever member 14, a pair of centering springs 12, a cable retaining means or cable guide 15, a pair of cable lengths 3, a plurality of pulleys 8 for the cables, a tension spring 4, a tension equalizer spring 2, a cable adjustment means or an adjustable turn buckle 5 and a fulcrum means having a fulcrum stand 13 and a fulcrum lever member 7.

In operation, the end opposite to the end of shaft member 11 is connected to cable lever member 14. Because shaft member 11 is journaled or otherwise rotationally connected to base structure 18, cable lever member 14, which extends generally vertical when at rest, rotates in the same manner as lever arm 1. Cable lever arm 14 has a pair of pins horizontally extending therefrom which abut respectively the upward projecting portions of centering springs 12. The centering springs 12 which are attached to base structure 18 keep or maintain cable lever member 14 in a generally vertical position either when at rest or subsequent to use. Likewise, lever arm 1 is maintained in the same position due to the direct communication with cable lever member 14.

At generally the top portion of cable lever member 14 is connected a cable 3. And the opposite end of that cable is connected to the tension equalizer spring 2 after communication with two pulleys 8. In proximity to and immediately above the top portion of cable lever member 14 is cable guide 15 which is connected to the base structure 18. The cable 3 extending from lever member 14 passes between the two pins extending from guide 15, and this arrangement allows the clockwise or counterclockwise rotational movement of lever arm 1 and thus lever member 14 to cause generally the same resistance force to result in that the cable passing between the pins of guide 15 is caused to slide in the same manner along either of the pins depending upon directional rotation. Thus, whether the lever arm 1 is rotated clockwise or counterclockwise, the same tension is placed on the cable, spring and fulcrum arrangement of the resistance force mechanism here shown.

After passing between guide 15 and around pulleys 8, cable 3 attaches to one end of the tension equalizer spring 2 which is connected at the opposite end to one end of fulcrum lever member 7. To the opposite end of the fulcrum lever member 7 is the other cable 3 which continues over a pulley 8 and extends generally downward to one end of adjustable turnbuckle 5, which in turn is connected at the opposite end to an anchored tension spring 4. Both springs 2 and 4 are of the spiraled coil, extension spring variety and are utilized to releasably absorb the rotational energy imparted by the user of the device. As can be seen, adjustment of turnbuckle 5 to either shorten or lengthen cable 3, the type of extension spring, the respective connection locations of cables 3 on either side of the fulcrum point at fulcrum stand 13, or the actual location of fulcrum point due to the rotational connection of fulcrum lever 7 to fulcrum stand 13, all can be utilized to control the amount rotational resistance imparted by the resistance force mechanism shown in FIG. 4.

Although the resistance force mechanism here shown is a cable, spring, fulcrum type arrangement, it would also be equally possible to utilize hydraulic cylinders, pneumatic cylinders or a torsion type resistance device. Additionally, many spring type arrangements are possible in combination with the cable guide 15 mechanism. However, the arrangement here shown has been found suitable, and adjustable at various locations as described above.

In conjunction with the rotational resistance force mechanism described, a score indicator dial or force readout means 19 can be easily installed for the benefit of the competitive user. The readout means 19 is adaptable to the deflection from vertical of the lever arm 1 by attaching a cable at the bottom portion of spring 2, or at any point within the mechanism which proportionally reflects that deflection distance. Additionally, by utilizing proper springs, fulcrum arrangement, etc. this deflection distance can be corrolated to the pounds of force required to maintain a specific arm lever 1 deflection. A readout ranging from 20 to 150 has been utilized in conjunction with a pointer that rotates about a calibrated dial. For competitive purposes, the score would remain on the dial so that it can be subsequently recorded.

Additionally, the device can be equipped with a locking mechanism 10 and unlocking arm 9 in conjunction with a coin operated mechanism for the device. This arrangement or embodiment would make the device suitable for, particularly, amusement purposes. In operation, subsequent to coin insertion, the unlocking arm 9 is activated and releases the lever arm 1 from its locked, vertical position.

FIG. 5 illustrates the device of the invention with an exterior cover which covers and is connected to the base structure 18 and which abuts the playing base 17. The exterior covering can be formed of a metal, plastic or combination of materials and suitably painted with instructions and the like. The covering has a clear portion which allows the score dial indicator 19 to be viewed from the exterior, and it has the shaft member 11 protruding therefrom.

The device, as mentioned above, can be mounted to a wall surface or to a pedestal so long as the proper standing or sitting height is effectuated for use.

As many changes are possible to the embodiments of this invention utilizing the teachings of the invention, the descriptions above and the accompanying drawings should be interpreted in the illustrative and not in the limited sense.

That which is claimed is:

1. A device for providing an adjustable clockwise and counterclockwise rotational resistance force in opposition to an individual user's rotation of the left or right forearm about the respective elbow joint, said device comprising:

(a) a base structure for receiving and supporting the remaining elements of said device, (b) elbow receiving means for supporting and placement of an elbow joint of a user, said receiving means being disposed at generally the frontal portion of said device, (c) a rigid lever arm extending upward when at rest in proximity to said elbow receiving means, said lever arm having an upper portion for hand gripping by a user and a lower portion having a shaft extending therefrom for forming a horizontal axis of rotation, said shaft having an upwardly extending bar member attached to its opposite end, said bar member further having a guide post fixed thereabove, said lever arm being disposed so that a user subsequent to elbow placement can grasp said upper portion of said lever arm, and, (d) adjustable rotational force resistance means being communicatively operable to both clockwise and counterclockwise rotation of said lever arm, said force resistance means being comprised of a fulcrum means attached to said base structure and having first and second tension force storing means attached to its opposing ends, said first tension force storing means further being attached at its opposite end to said base structure, said second tension force storing means being comprised of a cable and spring arrangement having the cable attached to the top portion of the bar member attached to said lever arm and further having the cable extending through said guide post member to provide clockwise and counterclockwise resistance forces in a generally equal manner as said lever arm is rotated, whereby, a user of said device subsequent to elbow placement and hand grasping of said lever arm utilizes said device for athletic or therapeutic purposes by overcoming said rotational resistance force, as either forearm is rotated about its respective elbow joint.

* * * * *